US006161782A

United States Patent [19]

Heinbuck et al.

[11] Patent Number: 6,161,782

[45] Date of Patent: Dec. 19, 2000

[54] ATOMIZING DISC AND FUEL INJECTION VALVE HAVING AN ATOMIZING DISC

[75] Inventors: Petra Heinbuck, Stuttgart; Frank Schatz, Kornwestheim; Günter Dantes, Eberdingen; Detlef Nowak, Untergruppenbach; Jörg Heyse, Besigheim, all of Germany

[73] Assignee: Robert Bosch GmbH, Stuttgart, Germany

[21] Appl. No.: 09/445,516

[22] PCT Filed: Jan. 18, 1999

[86] PCT No.: PCT/DE99/00089

§ 371 Date: Dec. 7, 1999

§ 102(e) Date: Dec. 7, 1999

[87] PCT Pub. No.: WO99/53193

PCT Pub. Date: Oct. 21, 1999

[30] Foreign Application Priority Data

Apr. 8, 1998 [DE] Germany ..... 198 15 795

[51] Int. Cl.[7] ..... B05B 1/34; F02M 51/00

[52] U.S. Cl. ..... 239/585.1; 239/491; 239/494; 239/590; 239/584; 239/596; 239/533.12

[58] Field of Search ..... 239/491, 494, 239/496, 497, 533.12, 584, 585.1, 585.4, 585.5, 590, 590.3, 596, DIG. 19

[56] References Cited

U.S. PATENT DOCUMENTS

| | | | |
|---|---|---|---|
| 5,484,108 | 1/1996 | Nally | 239/585.4 X |
| 5,570,841 | 11/1996 | Pace et al. | 239/585.1 |
| 5,685,491 | 11/1997 | Marks et al. | 239/596 X |
| 5,766,441 | 6/1998 | Arndt et al. | 239/596 X |
| 5,899,390 | 5/1999 | Arndt et al. | 239/585.1 X |
| 5,924,634 | 7/1999 | Arndt et al. | 239/596 X |
| 6,050,507 | 4/2000 | Holzgrefe et al. | 239/585.1 |

FOREIGN PATENT DOCUMENTS

| | | |
|---|---|---|
| 0 387 085 | 9/1990 | European Pat. Off. . |
| 39 43 005 | 7/1990 | Germany . |
| 196 07 288 | 10/1996 | Germany . |
| 196 37 103 | 3/1998 | Germany . |
| 60-222557 | 3/1986 | Japan . |
| 96/11335 | 4/1996 | WIPO . |

*Primary Examiner*—Andres Kashnikow
*Assistant Examiner*—Steven J. Ganey
*Attorney, Agent, or Firm*—Kenyon & Kenyon

[57] ABSTRACT

An atomizer disk is composed of at least one metallic material, is configured with at least one inlet opening in an upper cover layer and at least one outlet opening in a lower base layer, and has at least two swirl channels that terminate into a swirl chamber, the swirl chamber being provided in a middle swirl generation layer. Through the inlet opening and the swirl channels, two flows of different natures (biflux) enter the swirl chamber. All the layers of the atomizer disk are built up directly onto one another by electroplating metal deposition (multilayer electroplating). The atomizer disk is suitable for use in a fuel injection valve, in particular a high-pressure injection valve for direct injection of fuel into a combustion chamber of a mixture-compressing, spark-ignited internal combustion engine.

44 Claims, 5 Drawing Sheets

ATOMIZING DISC AND FUEL INJECTION VALVE HAVING AN ATOMIZING DISC

BACKGROUND INFORMATION

German Patent Application No. 39 43 005 describes an electromagnetically actuatable region. Upon excitation of the magnetic circuit, a flat valve plate functioning as a flat armature is lifted away from a valve seat plate located opposite and coacting with it; together they form a plate valve element. Arranged upstream from the valve seat plate is a swirl element that imparts a circular rotary motion to the fuel flowing toward the valve seat. A stop plate limits the axial travel of the valve plate on the side opposite the valve seat plate. The valve plate is surrounded by the swirl element with a large clearance; the swirl element thus provides a certain guidance for the valve plate. Recessed in the swirl element on its lower end face are several tangentially extending grooves which proceed from the outer periphery and extend into a central swirl chamber. Because the swirl element rests with its lower end face on the valve seat plate, the grooves exist as swirl channels.

International Publication No. WO 96/11335 describes a fuel injection valve at whose downstream end is arranged a multiple-disk atomization extension with a swirl preparation function. This atomization extension is also provided on the valve seat support, downstream from a disk-shaped guide element built into a valve seat support, and from a valve seat; an additional support element holds the atomization extension in a defined position. The atomization extension is embodied with two disks or four disks, the individual disks being manufactured from stainless steel or silicon. Conventional machining methods, such as electrodischarge machining, punching, or etching, are correspondingly used in the manufacture of the opening geometries in the disks. Each individual disk of the atomization extension is fabricated separately, after which, in accordance with the desired number of disks, all the disks of the same size are stacked onto one another to form the complete atomization extension.

German Patent Application No. 196 07 288 describes a so-called multilayer electroplating process for manufacturing orifice disks that are suitable, in particular, for use in fuel injection valves. The disclosure of this German Patent Application which describes a principle for manufacturing disks by multiple electroplating deposition of variously structured metals onto one another, resulting in an integral disk, is explicitly incorporated herein by reference. Microelectroplating metal deposition in several planes, plies, or layers is also used to manufacture the atomization disks according to the present invention.

SUMMARY OF THE INVENTION

The atomizer disk according to the present invention has the advantage that it can be manufactured in particularly economical fashion. One advantage is the fact that the atomizer disks can be produced simultaneously, reproducibly, and extremely precisely in very large quantities (excellent batch capability). Because of they are made of metal, atomizer disks of this kind are highly resistant to breakage and easy to install, for example on injection valves or other spray discharge nozzles of any kind. The use of multilayer electroplating allows extremely wide design freedom, since the contours of the opening regions (inlet regions, swirl channels, swirl chamber, outlet opening) in the atomizer disk can be selected without restriction. This flexible shaping is very advantageous especially as compared to silicon disks, in which the achievable contours (truncated pyramids) are strictly defined by the crystal axes.

Metallic deposition has the advantage, especially as compared to the manufacture of silicon disks, of a wide selection of materials. A wide variety of metals, with their different magnetic properties and hardnesses, can be utilized in the microelectroplating method used to manufacture the atomizer disks.

The extensive design freedom for the contours inside the atomizer disk resulting from the manner of manufacture has, in turn, the great advantage that different shapes can easily be produced for the spray that is discharged. For example, spray profiles in the form of hollow cones, oblique hollow cones, solid cones, oblique solid cones, stranded cones, or flat sprays can be achieved, all of them conditioned in outstanding fashion by imparting swirl in the swirl disk. In particularly advantageous fashion, undercuts and overlaps can be achieved easily, economically, and with extremely high precision by multilayer electroplating.

It is also advantageous to configure the atomizer disk in such a way that the at least one inlet opening for a first inflow terminates directly into the swirl chamber, and a further inflow to the swirl chamber, at times independent thereof, takes place via the swirl channels. Obliquely discharging sprays can be produced very easily with a biflux atomizer disk of this kind that carries two flows within it.

It is also advantageous to construct the swirl disk, which includes three layers, by performing three electroplating steps for metal deposition. The upstream layer represents a cover layer that covers the swirl chamber of a middle swirl generation layer. The swirl generation layer is constituted by one or more material regions that define, because of their contouring and their geometrical position with respect to one another, the contours of the swirl chamber and the swirl channels. With the electroplating process, the individual layers are built up onto one another without joins or seams, so that they represent continuously homogeneous material. To that extent, the term "layers" is to be taken as an aid to understanding.

Advantageously, two, three, four, or six swirl channels are provided in the swirl disk. The material regions can possess very different shapes corresponding to the desired contouring of the swirl channels, e.g. can be strut-like or helical. Advantageously, the contours of the swirl chamber, the cover layer, and the outlet opening can also be configured flexibly; particular inclined (e.g. engine-specific) spray profiles and spray shapes can be produced by way of asymmetries in specific opening contours. The production of sprays or streams inclined at an angle y to the axis of symmetry of the swirl disk (hollow or solid cone, large or small strand component over the periphery, homogeneous or inhomogeneous distribution over the periphery, rotationally asymmetrical (flat) spray profiles with adjustable strand components) in simple fashion and without additional components having defined oblique spray discharge contours (oblique holes), represents an extraordinarily important advantage of the atomizer disks according to the present invention.

It is thus possible to produce inclined sprays having the aforesaid properties without downstream components manufactured by precision engineering, The fuel injection valve according to the present invention has the advantage of yielding a very high atomization quality in a fuel that is to be sprayed out, as well as spray shaping that is adapted to the respective requirements (e.g. installation conditions, engine configurations, cylinder shapes, spark plug position). Among the consequences of using multilayer electroplated atomizer disks on an injection valve of an internal combustion engine is the fact that the exhaust emissions of the internal combustion engine are reduced, and also that a decrease in fuel consumption is attained.

It is also possible to logically deduce corresponding advantages for use on a fuel injection valve, since the simplified and highly reproducible method for manufacturing the atomizer disks, coupled with the highly efficient swirl generation in the fluid (in this case, fuel), result in the same advantages of high quality, homogeneous ultrafine atomization, wide variety of spray shapes, and cost reduction.

When an engine operates with direct gasoline injection, the problem generally occurs that carbon deposits occur on the downstream tip of the injection valve projecting into the combustion chamber due to gasoline deposition. In the case of previously known injection valves projecting into the combustion chamber, there thus exists, over their entire service life, the risk of an adverse influence on spray parameters (e.g. static flow volume, spray angle), which can even result in failure of the injection valve. By using, at the downstream end of the fuel injection valve, the multilayer electroplated atomizer disk made of nickel or nickel-cobalt as the material, carbon deposition in this region is effectively prevented. Other suitable materials are cobalt oxide and nickel oxide, and oxides of alloys of the aforesaid metals. When the atomizer disk is constructed from such materials, complete combustion of the carbon particles is catalyzed, and deposition of carbon particles is prevented. Catalytic effectiveness is also exhibited by the noble metals Ru, Rh, Pd, Os, Ir, and Pt, and alloys of these metals with one another or with other metals.

DETAILED DESCRIPTION

Figure 1:
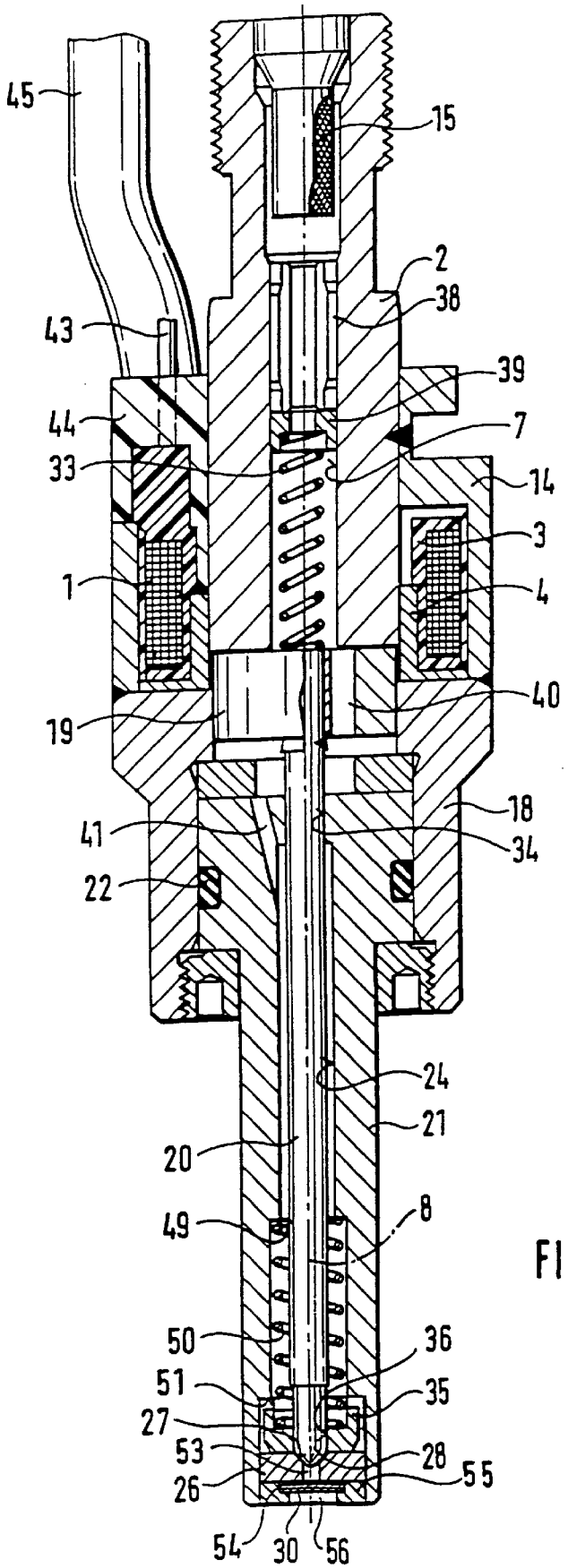
FIG. 1 shows a cross-section view of a fuel injection valve which can be equipped with an atomizer disk.

The electromagnetically actuable valve depicted in exemplary fashion in FIG. 1, in the form of an injection valve for fuel injection systems of mixture-compressing, spark-ignited internal combustion engines, has a tubular and largely hollow-cylindrical core 2 that is at least partially surrounded by a magnet coil 1 and serves as the inner pole of a magnetic circuit. The fuel injection valve is suitable particularly as a high-pressure injection valve for direct injection of fuel into a combustion chamber of an internal combustion engine. An injection valve (for gasoline or diesel use, for direct or intake manifold injection) represents only one important application for the use of the atomizer disks according to the present invention that are described in more detail below. These atomizer disks can also be utilized in inkjet printers, on nozzles for spraying liquids of any kind, or in inhalers. The atomizer disks according to the present invention are quite generally suitable for producing fine sprays with a swirl component.

A coil body 3, made of plastic and, for example, stepped, receives a winding of magnet coil 1 and makes possible, in combination with core 2 and an annular, nonmagnetic spacing element 4 with an L-shaped cross section that is partially surrounded by magnet coil 1, a particularly compact and short configuration of the injection valve in the region of magnet coil 1.

Provided in core 2 is a continuous longitudinal opening 7 that extends along a longitudinal valve axis 8. Core 2 of the magnetic circuit serves also as a fuel inlet fitting, longitudinal opening 7 representing a fuel delivery duct. Joined immovably to core 2 above magnet coil 1 is an outer metallic (e.g. ferritic) housing part 14 that, as the external pole or external conductive element, closes the magnetic circuit and completely surrounds magnet coil 1 at least in the circumferential direction. Provided in longitudinal opening 7 of core 2 on the inlet side is a fuel filter 15 that filters out those fuel constituents that, because of their size, might cause clogging or damage in the injection valve. Fuel filter 15 is secured in core 2, for example, by being pressed in.

Core 2 constitutes, with housing part 14, the inlet-side end of the fuel injection valve; upper housing part 14 extends, for example viewed downstream in the axial direction, just beyond magnet coil 1. Adjoining upper housing part 14 in sealed and immovable fashion is a lower tubular housing part 18 that encloses and receives, for example, an axially movable valve part comprising an armature 19 and a rod-shaped valve needle 20, and an elongated valve seat support 21. The movable valve part could, however, also have, for example, the shape of a flat disk with an integrated armature. The two housing parts 14 and 18 are immovably joined to one another, e.g. with a circumferential weld seam.

In the exemplary embodiment depicted in FIG. 1, lower housing part 18 and the largely tubular valve seat support 21 are immovably joined to one another by thread-joining, although welding, soldering, or crimping also constitute possible joining methods. Sealing between housing part 18 and valve seat support 21 is accomplished, for example, by way of a sealing ring 22. Valve seat support 21 possesses over its entire axial extension an inner passthrough opening 24 that extends concentrically with longitudinal valve axis 8.

With its lower end 25, which also simultaneously represents the downstream termination of the entire fuel injection valve, valve seat support 21 surrounds a disk-shaped valve seat element 26, fitted into passthrough opening 24, having a valve seat surface 27 that tapers downstream in truncated conical shape. Arranged in passthrough opening 24 is valve needle 20, which is, for example, rod-shaped and has a substantially circular cross section, and has at its downstream end a valve closure segment 28. This valve closure segment 28, which for example tapers conically, coacts in known fashion with valve seat surface 27 provided in valve seat element 26. Following valve seat element 26 downstream of valve seat surface 27 is an atomizer disk 30 according to the present invention, which is manufactured by multilayer electroplating and includes three metallic layers deposited onto one another.

Actuation of the injection valve is accomplished, in known fashion, electromagnetically. The electromagnetic circuit having magnet coil 1, core 2, housing parts 14 and 18, and armature 19 serves to move valve needle 20, and thus to open the injection valve against the spring force of a return spring 33 arranged in longitudinal opening 7 of core 2, and to close it. Armature 19 is joined to the end of valve needle 20 facing away from valve closure segment 28 by e.g. a weld seam, and is aligned on core 2. Guidance of valve needle 20 during its axial movement along with armature 19 along longitudinal valve axis 8 is provided on the one hand by a guide opening 34 provided in valve seat support on the end facing toward armature 19, and on the other hand by a disk-shaped guide element 35, arranged upstream from valve seat element 26, having a dimensionally accurate guide opening 36. Armature 19 is surrounded by spacing element 4 during its axial movement.

Instead of the electromagnetic circuit, it is also possible for a different energizable actuator, for example a piezostack, to be used in a comparable fuel injection valve; or for actuation of the axially movable valve part to be accomplished via hydraulic pressure or servo pressure.

An adjusting sleeve 38 that is inserted, pressed, or threaded into longitudinal opening 7 of core 2 serves to adjust the spring pre-tension of return spring 33, which rests via a centering piece 39 with its upstream end against adjusting sleeve 38 and braces with its opposite end against armature 19. Provided in armature 19 are one or more bore-like flow channels 40, through which the fuel can pass from longitudinal opening 7 in core 2, out of connecting channels 41 configured downstream from flow channels 40 near guide opening 34 in valve seat support 21, into passthrough opening 24.

The linear stroke of valve needle 20 is defined by the installation position of valve seat element 26. One end position of valve needle 20, when magnet coil 1 is not energized, is defined by contact of valve closure segment 28 against valve seat surface 27 of valve seat element 26, whereas the other end position of valve needle 20, when magnet coil 1 is energized, results from contact of armature 19 against the downstream end face of core 2. The surfaces of the components in the aforementioned stop region are, for example, chrome-plated.

Electrical contacting to magnet coil 1, and thus energization thereof, are accomplished via contact elements 43 that are equipped, outside coil body 3, with an injection-molded plastic sheath 44. Injection-molded plastic sheath 44 can also extend over further components (e.g. housing parts 14 and 18) of the fuel injection valve. Extending out from injection-molded plastic sheath 44 is an electrical connector cable 45 through which current flows to magnet coil 1. Injection-molded plastic sheath 44 projects through upper housing part 14, which is interrupted in this region.

Downstream of guide opening 34, passthrough opening 24 of valve seat support 21 is embodied, for example, with two steps. A first shoulder 49 serves as contact surface for a, for example, helical compression spring 50. An enlarged installation space for the three disk-shaped elements 35, 26, and 30 is created by way of second step 51. Compression spring 50 enveloping valve needle 20 compresses guide element 35 in valve seat support 21, since it presses with its end opposite shoulder 49 against guide element 35. An outlet opening 53 is made in valve seat element 26 downstream from valve seat surface 27; the fuel that flows along valve seat surface 27 when the valve is open flows through this, and then enters atomizer disk 30. Atomizer disk 30 is present, for example, in a depression 54 of a disk-shaped retaining element 55, retaining element 55 being joined immovably to valve seat support 21 by, for example, welding, adhesive bonding, or clamping. The attachment variant for atomizer disk 30 shown in FIG. 1 is depicted in only simplified fashion, and shows only one of many variable attachment possibilities. What is critical is the arrangement in principle of atomizer disk 30, deposited by microelectroplating, downstream from valve seat surface 27. Configured in retaining element 55 downstream from depression 54 facing toward the valve seat is a central outlet opening 56 through which the fuel, to which a swirl has now been imparted, leaves the fuel injection valve.

Figure 2:
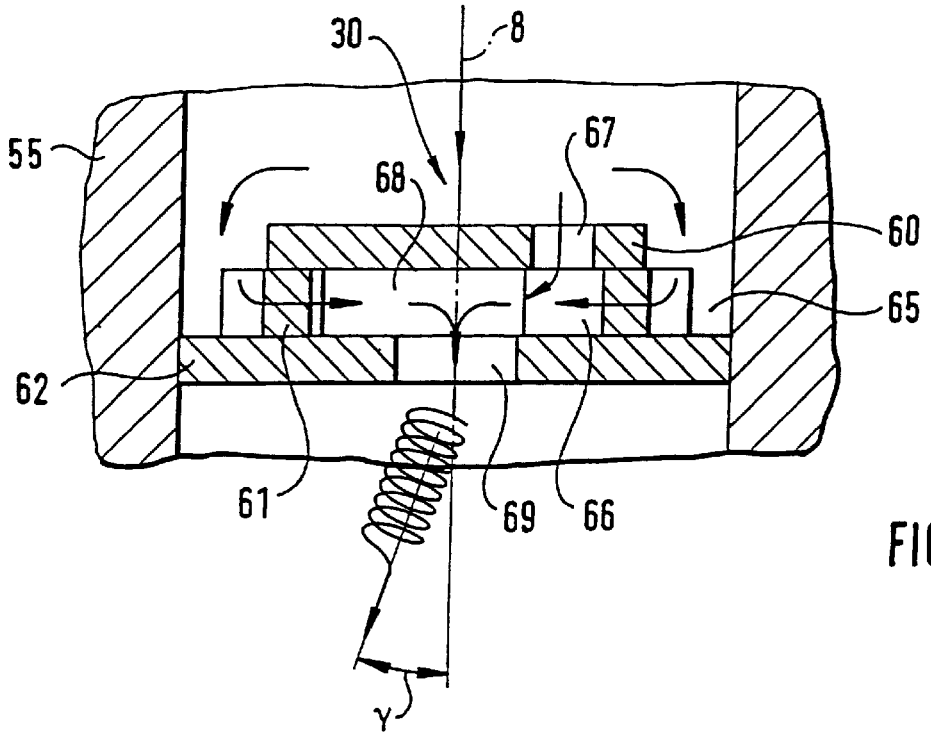
FIG. 2 shows a cross-sectional view of the atomizer disk taken along line III—III illustrated in FIG. 3.
Figure 3:
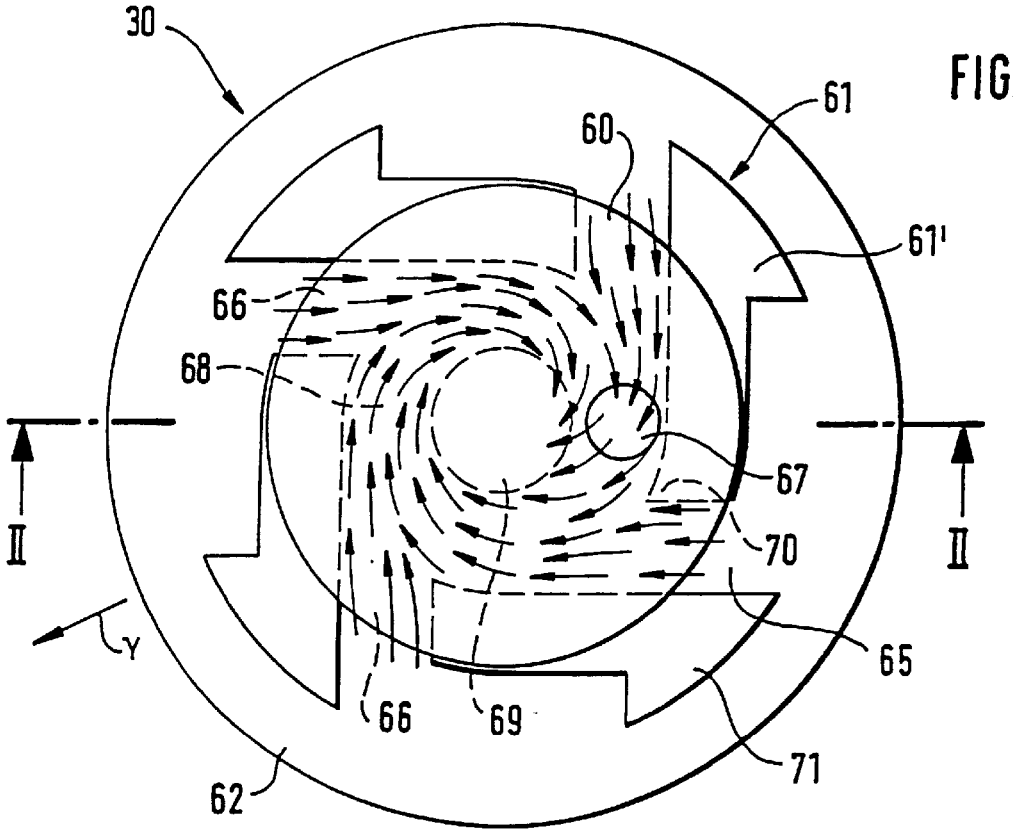
FIG. 3 shows a top view of a first exemplary embodiment of a multilayer electroplated atomizer disk.

FIG. 2 shows a section along line II—II provided in FIG. 3 in order to illustrate the disk construction. Different cross-hatchings were selected in FIG. 2 for the individual deposited layers, although it is expressly to be emphasized that atomizer disks 30 are integral components, since the individual layers are deposited directly onto one another, and not fitted together later. The layers of atomizer disk 30 are deposited onto one another by electroplating, so that the successive layer joins immovably to the layer below by galvanic adhesion.

Atomizer disk 30 has an outside diameter such that it can be fitted tightly, with little clearance, into a receiving opening on the fuel injection valve, e.g. into depression 54 of retaining element 55 or into an opening of valve seat support 21. Atomizer disk 30 is formed from three planes, plies, or layers deposited by electroplating onto one another which thus, once installed, succeed one another axially. The three layers of atomizer disk 30 will hereinafter be referred to, in accordance with their function, as cover layer 60, swirl generation layer 61, and base layer 62. As is evident from FIG. 2, the upper cover layer 60 is configured with a smaller outside diameter than lower layer 62. This ensures on the one hand that fuel can flow past on the outside of cover layer 60 and thus unimpededly enter outer inlet regions 65 of, for example, four swirl channels 66 in the middle swirl generation layer 61 (see arrows indicating flow in FIG. 2). On the other hand, there is made in the upper cover layer 60 an inlet opening 67 through which a portion of the fuel can flow directly, so that what exists is a so-called biflux atomizer disk with two largely separate flows. Atomizer disks 30 can also be manufactured in accordance with the present invention with more than three layers; in such cases as well, the structure of layers 60, 61, 62 as described above is of comparable appearance, although a fourth patterned layer (not depicted), which may be advisable for specific installation conditions and for inflow-related reasons, is also grown on cover layer 60.

Atomizer disks 30 according to the present invention are built up in multiple metal layers by electroplating deposition (multilayer electroplating). Manufacturing with electroplating technology and three-dimensional lithography yields particular advantages in terms of contouring, some of which are listed in brief and summary fashion below:

- Layers have a constant thickness over the disk surface;
- Because of the three-dimensional lithographic patterning, essentially vertical orifices are created in the layers to form the respective cavities through which flow occurs (deviations of approx. 3° from optimally vertical walls may occur for production-related reasons);
- Intentional undercuts and overlaps in the orifices can be produced by building up multiple plies of individually patterned metal layers;
- Orifices can have any desired cross-sectional shape with essentially axially parallel walls;
- The swirl disk is of integral configuration, since the individual metal deposits are produced directly onto one another.

The method for manufacturing atomizer disks 30 will be explained only in abbreviated form in the paragraphs that follow. All the method steps of electroplating metal deposition for manufacturing an orifice disk have already been explained in detail in German Patent Application No. 196 07 288. A characteristic of the method of successive application of photolithographic steps (UV three-dimensional lithography) and subsequent microelectroplating is that it guarantees high-precision patterns even over a large area, so that it is ideally usable for mass production with very large unit volumes (excellent batch capability). A plurality of swirl disks 30 can be fabricated simultaneously on one panel or wafer.

The starting point for the method is a flat and stable support plate that can be made, for example, of metal (titanium, steel), silicon, glass, or ceramic. Optionally, at least one auxiliary layer is first applied onto the support plate. This is, for example, an electroplating starter layer (e.g. TiCuTi, CrCuCr, Ni) that is necessary for electrical conductivity for subsequent microelectroplating. Application of the auxiliary layer is accomplished, for example, by sputtering or by electroless metal deposition. After this pretreatment of the support plate, a photoresist is applied, e.g. rolled or spun-coat, onto the entire surface of the auxiliary layer.

The thickness of the photoresist should correspond to the thickness of the metal layer that is to be created in the electroplating process that will occur later, i.e. to the thickness of the lower base layer 62 of atomizer disk 30. The resist layer can comprise one or more plies of a photopatternable film or a liquid resist (polyimide, photoresist). If a sacrificial layer is optionally to be electroplated into the lacquer structures that are produced later, the thickness of the photoresist must be increased by an amount equal to the thickness of the sacrificial layer. The metal pattern to be created is to be transferred inversely into the photoresist with the aid of a photolithographic mask. One possibility is to expose the photoresist directly through the mask (circuitboard or semiconductor exposure device) using UV illumination (three-dimensional UV lithography), and then develop it.

The negative pattern of the subsequent layer 62 of atomizer disk 30 ultimately created in the photoresist is filled up with metal (e.g. Ni, NiCo, NiFe, NiW, Cu) by electroplating (metal deposition). The electroplating process causes the metal to conform closely to the contour of the negative pattern, so that the predefined contours are reproduced in it with geometrical fidelity. In order to create the structure of atomizer disk 30, the steps following the optional application of the auxiliary layer must be repeated in accordance with the number of layers desired, so that in the case of a three-layer atomizer disk 30, three electroplating steps are performed. It is also possible to use different metals for the layers of an atomizer disk 30, but they can be used in each case only in a new electroplating step.

In manufacturing cover layer 60 of atomizer disk 30, metal is deposited both onto the conductive material regions 61' and onto the nonconductive photoresist in the region of swirl channels 66 and swirl chamber 68. For this, a starter layer metallization is applied onto the resist of the preceding middle layer 61. After deposition of the upper cover layer 60, the remaining photoresist is dissolved out of the metal structures by wet-chemical stripping. In the case of flat, passivated support plates (substrates), atomizer disks 30 can be detached from the substrate and sectioned. In the case of support plates to which atomizer disks 30 adhere well, the sacrificial layer is etched away selectively with respect to the substrate and atomizer disk 30, so that atomizer disks 30 can be lifted off from the support plate and sectioned.

FIGS. 4–7 show several exemplary embodiments of multilayer electroplated atomizer disks 30 in plan views. These various embodiments can each serve, depending on the desired application, to generate ordinary rotationally symmetrical spray cones, and also flat spray profiles or inclined asymmetrical spray profiles.

Atomizer disk 30 provided in FIG. 2 shown in a plan view in FIG. 3 has an upper cover layer 60 having the at least one inlet opening 67, by way of which, in addition to swirl generation in swirl generation layer 61, a further but unswirled fluid component is created. A complex opening contour, extending over the entire axial thickness of swirl generation layer 61, is provided as the flow geometry in that layer 61. The opening contour of middle layer 61 is constituted by an inner swirl chamber 68 and a plurality of swirl channels 66, terminating into swirl chamber 68, whose contours result in turn from material regions 61' deposited in middle layer 61.

Atomizer disk 30 shown in FIG. 3 possesses in middle layer 61 a largely circular swirl chamber 68 and four swirl channels 66. Swirl channels 66, which for example each run perpendicular to the adjacent swirl channels 66, terminate tangentially in swirl chamber 68. The fact that swirl channels 66 terminate tangentially in swirl chamber 68 causes the fuel to have impressed upon it a rotary momentum that is thus retained even in a central circular outlet opening 69 of lower base layer 62. The diameter of outlet opening 69 is, for example, much smaller than the inside width of swirl chamber 68 located directly above it. This amplifies the swirl intensity produced in swirl chamber 68. In the exemplary embodiment depicted in FIGS. 2 and 3, inlet opening 67 is configured completely above swirl chamber 68, but with a complete offset with respect to outlet opening 69 which is provided centrally in base layer 62. This means, in other words, that if the two openings 67 and 69 are projected into one plane, no overlap exists, so that a definite radial component is imparted to the fuel flowing in through inlet opening 67. After the fuel has flowed in the axial direction in through inlet opening 67, the flow experiences, on its shortest path to outlet opening 69, a transverse velocity component deviating from the axial direction.

As a result of centrifugal force and the superposition of swirl flow and transverse flow, the fuel is sprayed out in a hollow conical shape, and at an inclination to longitudinal valve axis 8. The arrows in swirl chamber 68 (FIG. 3) indicate the flow conditions. Depending on the contouring, the resulting lateral spray deflection can be influenced to a greater or lesser extent by the swirl flow. As shown in FIG. 3, the spray direction labeled with an arrow and y can deviate somewhat, because of the swirl direction, from the direction of the shortest connecting line between inlet opening 67 and outlet opening 69. In this context, y indicates the angle of the spray with respect to the axis of symmetry of atomizer disk 30.

The four material regions 61' of swirl generation layer 61 are each strut-shaped, and are configured with a spacing from the outer rim of atomizer disk 30. Material regions 61' lie largely perpendicular to the respective adjacent material regions 61' and form, at a defined spacing from one another, swirl channels 66 covered by cover layer 60. Ends 70 that radially delimit swirl chambers 68 are, for example, rounded off in a blade shape, so that the contour of material regions 61' already serves to generate swirl in the fuel that is to be sprayed out, and a circular swirl chamber 68 is formed. Ends 71 of material regions 61' opposite inner ends 70 are, for example, broadened on their outer contour and also rounded off, defining a fitting diameter with which swirl disk 30 can easily be inserted into and mounted in, for example, an opening of a fuel injection valve.

Figure 4:
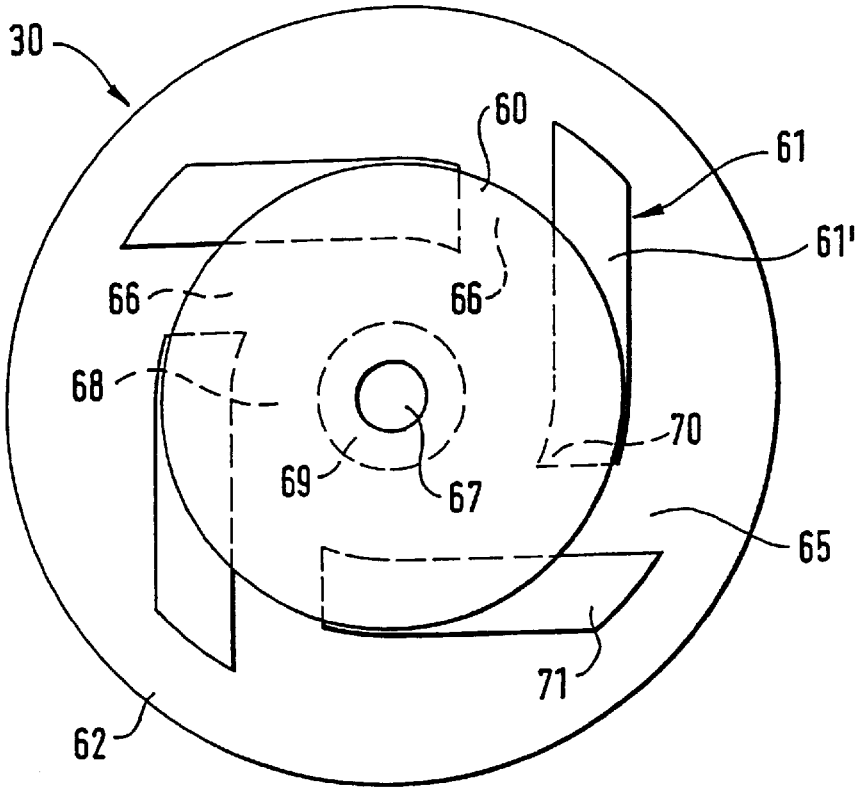
FIG. 4 shows a top view of a second exemplary embodiment of the multilayer electroplated atomizer disk.
Figure 5:
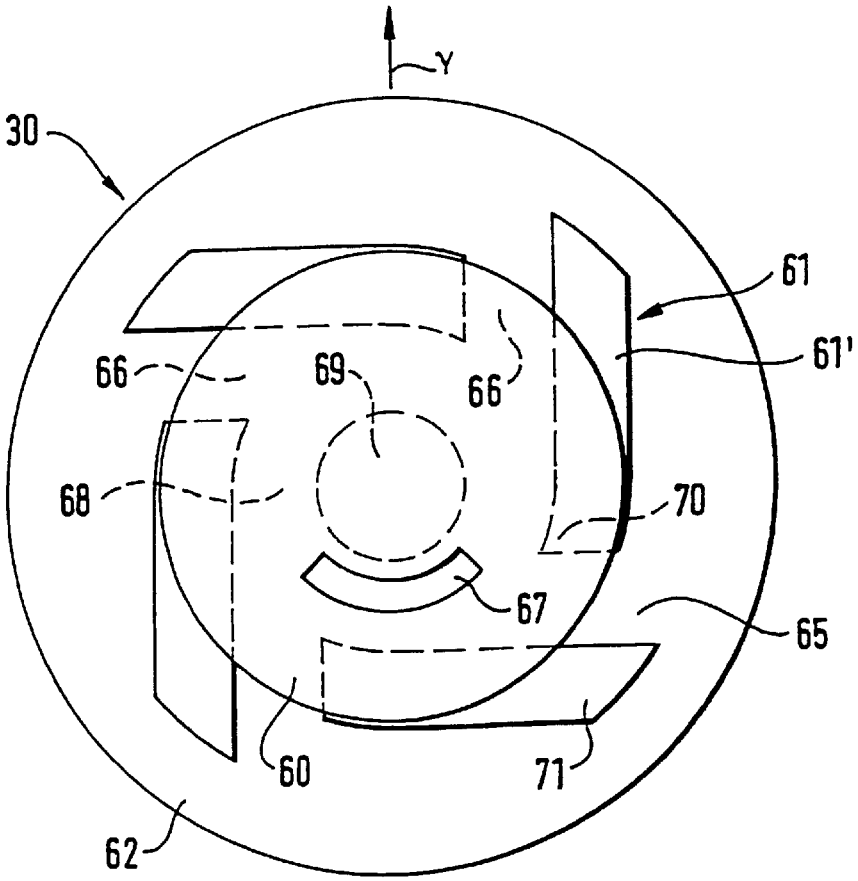
FIG. 5 shows a top view of a third exemplary embodiment of the multilayer electroplated atomizer disk.
Figure 6:
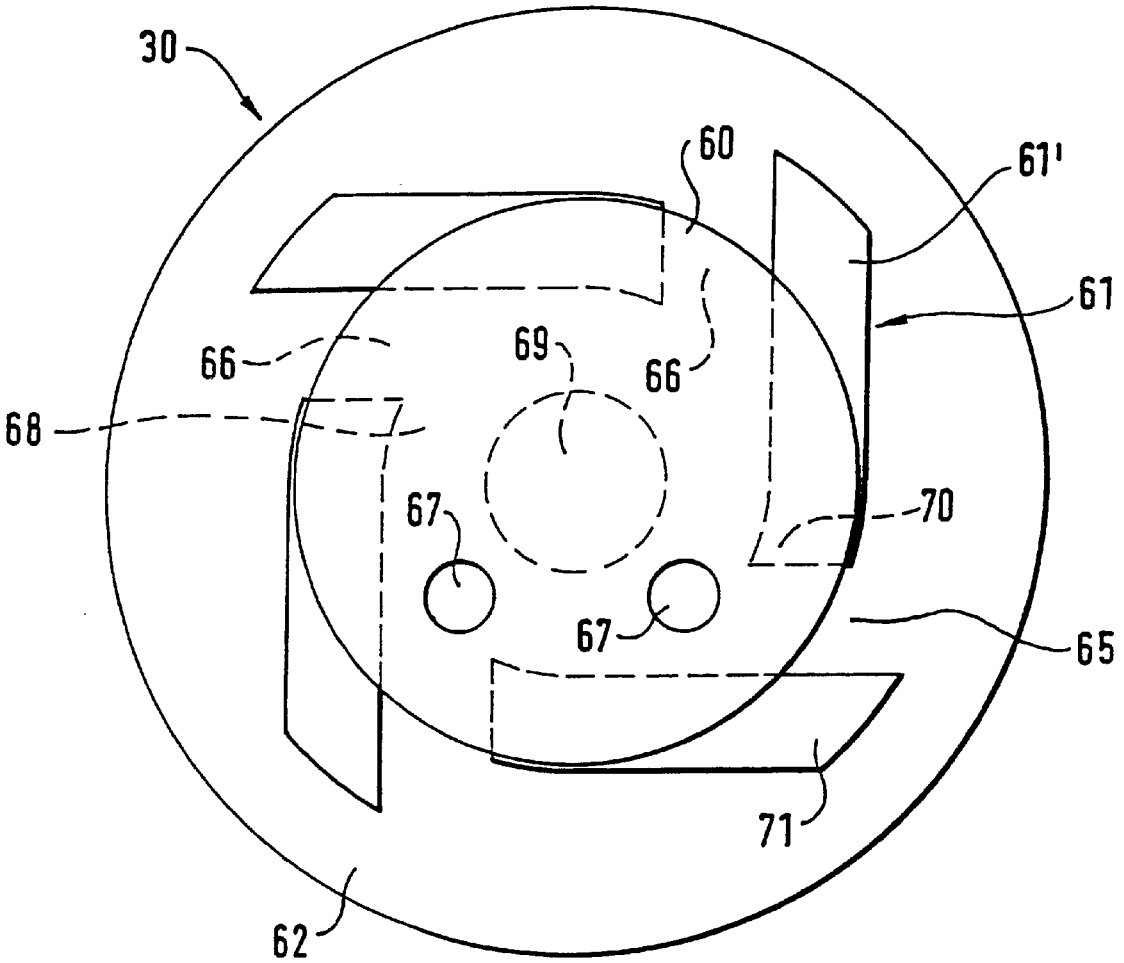
FIG. 6 shows a top view of a fourth exemplary embodiment of the multilayer electroplated atomizer disk.

FIGS. 4, 5, and 6 depict atomizer disks 30 which illustrate further possibilities for configuring the at least one inlet opening 67 in cover layer 60. Whereas the contours of swirl chamber 68 and swirl channels 66, and of material regions 61', largely match those of atomizer disk 30 as shown in FIG. 3, the further three exemplary embodiments show variants in terms of the quantity and contours of inlet opening 67. For example, circular inlet opening 67 having a smaller diameter is arranged concentrically with circular outlet opening having a larger diameter (FIG. 4) in order to generate a narrow, compact stream with no y deflection. An inlet opening 67 that extends in a sickle shape or in the shape of a circular segment, but possesses a complete offset with respect to the outlet opening, is made in atomizer disk 30 as shown in FIG. 5. This kind of configuration offers the advantage of wider-area—and therefore more diffuse—mixing with the swirled flow. FIG. 6 shows an atomizer disk 30 in whose cover layer 60 are provided two inlet openings 67 that are both offset with respect to outlet opening 69. The oblique orientation of the spray can be very easily adjusted by way of the size of the offset between inlet openings 67 and outlet opening 69.

In addition to the embodiments described, above it is equally possible to configure inlet openings 67 that exhibit a partial offset, i.e. a certain overlap, with respect to outlet opening 69. Also conceivable are more than one or two inlet openings 67, which can also possess contours deviating from the contours shown. A feature common to all the exemplary embodiments so far described is the fact that the at least one inlet opening 67 terminates directly in swirl chamber 68 for a first inflow, and that a further inflow to swirl chamber 68, independent thereof, occurs via swirl channels 66.

As described above, it is common in various applications of orifice disks—and especially desirable in swirl disks—to generate inclined spray profiles having an angle y with respect to the longitudinal axis. For direct gasoline injection, for example, injection valves that discharge a spray inclined obliquely with respect to longitudinal valve axis 8 are advantageous because of specific installation conditions directly on the combustion chamber. In one possible variant, for example, a swirled hollow-conical spray, as rotationally symmetrical as possible and having a homogeneous distribution over the periphery of the hollow cone, is generated. In the case of known swirl disks or swirl attachments, this kind of spray discharge is possible only by using obliquely oriented exit holes in downstream spray discharge components.

One of the features of the present invention is that geometries for atomizer disk 30 have been discovered with which the goal recited above is achieved in very simple fashion. It must be noted in this context that atomizer disk 30 manufactured by multilayer electroplating has, because of the manufacturing technology, only largely vertical walls, with which, if the walls are considered in isolation, it appears that oblique spray discharge is still not possible. Advantageously, however, the asymmetry in contouring guarantees oblique spray discharge even with the vertical walls in atomizer disk 30; it is moreover advantageous that added-on components manufactured by precision engineering, into which an obliquely oriented spray hole could of course easily be introduced, can be dispensed with. Added-on components are, however, of course conceivable in order to enhance the effect already achieved with atomizer disk 30, or to support or allow simple mounting of atomizer disk 30.

A swirled, rotationally symmetrical, hollow conical spray having a homogeneous distribution over the hollow conical periphery represents only one spray shape, described here in more detail, for the oblique spray discharge; nevertheless, the other spray shapes already presented in the introduction to the description, i.e. even those that exhibit inhomogeneous distributions and strands, can also be produced by corresponding asymmetrical contouring in all the layers of atomizer disk 30.

Figure 7:
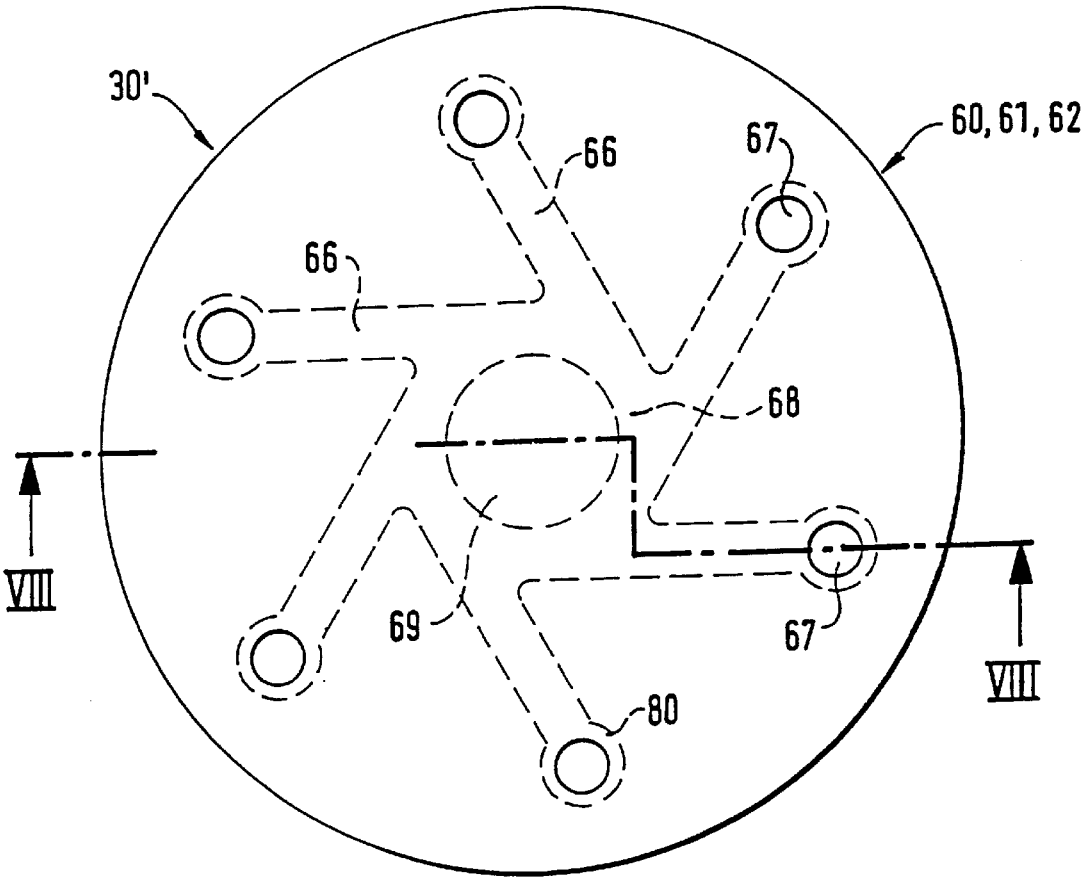
FIG. 7 shows a top view of a fifth exemplary embodiment of the multilayer electroplated atomizer disk.
Figure 8:
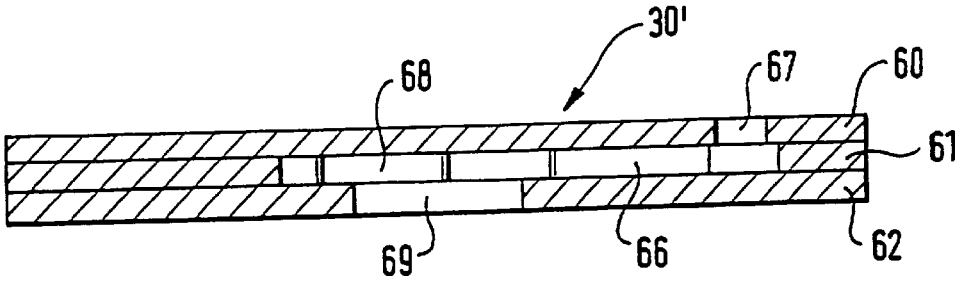
FIG. 8 shows a sectional view of the atomizer disk along line VIII—VIII which is illustrated in FIG. 7.

FIGS. 7 and 8 depict a further exemplary embodiment of an atomizer disk 30, FIG. 8 depicting a section along line VIII—VIII provided in FIG. 7. This atomizer disk 30 is not a biflux atomizer disk 30 (FIGS. 2 through 6) but rather a "prethrottled" atomizer disk 30'. In contrast to atomizer disks 30 described above, atomizer disk 30' has inlet openings 67 that are not arranged directly above swirl chamber 68 and therefore also do not terminate directly in it. Instead, inlet openings 67 terminate into swirl channels 66, specifically at their ends 80 facing away from swirl chamber 68.

An advantage of this arrangement is that each inflow cross section of inlet openings 67, lying in the plane of the drawing, is smaller than the smallest vertical swirl channel cross section that results perpendicular to the plane of the drawing and is determined by the height and width of the respective swirl channel 66. Inlet openings 67 are thus both a prethrottle and the flow-determining cross section of atomizer disk 30'. This type of throttling by way of inlet openings 67 in cover layer 60 guarantees an improvement in the quantitative tolerance of the flow volume at any spray angle.

Atomizer disk 30' exhibits other features differing from the embodiment described above. First all three layers 60, 61, and 62 possess an identical outside diameter, middle swirl generation layer 61 comprising only a single coherent material region 61'. Swirl channels 66, terminating largely tangentially into swirl chamber 68, are therefore not connected, with their ends 80 facing away from swirl chamber 68, to the outer circumference of atomizer disk 30'. Instead, a circumferential edge region of material region 61' remains between ends 80 of swirl channels 66 and the outer circumference of atomizer disk 30'. With the edge region, atomizer disk 30' can be particularly easily gripped at its periphery for mounting. In addition to the examples already described of atomizer disk 30 with four swirl channels 66, FIG. 7 is illustrates that a different number of swirl channels 66 (e.g. six) can also be manufactured by multilayer electroplating.

What is claimed is:

1. An atomizer disk composed of at least one metallic material and having a complete passage for a fluid, the atomizer disk comprising:

a lower base layer including at least one outlet opening;

a middle swirl generation layer including a swirl chamber;

at least two swirl channels extending to the swirl chamber;

an upper cover layer including at least one inlet opening situated only above the swirl chamber; and inlet regions situated externally from the upper cover layer for supplying the fluid to the swirl channels, wherein the lower base layer, the middle swirl generation layer and the upper cover layer are built up on one another in a directly adhering manner using an electroplating metal deposition procedure.

2. The atomizer disk according to claim 1, wherein the middle swirl generation layer is composed of a plurality of material regions which are spaced apart from one another in a circumferential direction, the material regions defining the contours of the swirl chamber and the swirl channels using respective geometrical positions of the material regions with respect to one another.

3. The atomizer disk according to claim 2, wherein the material regions include four material regions, and wherein the swirl chamber and four channels of the swirl channels are arranged between the four material regions.

4. The atomizer disk according to claim 2, wherein the material regions extend at a predetermined distance from an outer circumference of the lower base layer, the lower base layer defining an outside diameter of the atomizer disk.

5. The atomizer disk according to claim 4, wherein the material regions extend in a strut-like manner.

6. The atomizer disk according to claim 4, wherein the material regions have ends which face toward the swirl chamber, the ends being rounded off in a blade shape.

7. The atomizer disk according to claim 2, wherein the material regions delimit the swirl chamber which has one of a circular shape, an elliptical shape, a polygonal shape and a combination of the circular, elliptical and polygonal shapes.

8. The atomizer disk according to claim 1, wherein the at least one inlet opening exhibits one of a partial offset and a complete offset with respect to the at least one outlet opening.

9. The atomizer disk according to claim 1, wherein the at least one inlet opening is provided concentrically with the at least one outlet opening.

10. The atomizer disk according to claim 1, wherein the at least one outlet opening has a circular shape, an elliptical shape, a polygonal shape and a combination of the circular, elliptical and polygonal shapes.

11. The atomizer disk according to claim 1, wherein the at least one outlet opening is arranged in the lower base layer substantially in one of a centroid manner and an eccentric manner with respect to an axis of symmetry of the atomizer disk.

12. The atomizer disk according to claim 1, wherein the upper cover layer has an outside diameter which is smaller than an outside diameter of the lower base layer.

13. The atomizer disk according to claim 1, wherein the atomizer disk is provided for an injection valve.

14. The atomizer disk according to claim 1, wherein the electroplating metal deposition procedure includes a multilayer electroplating procedure.

15. An atomizer disk composed of at least one metallic material and including a complete passage for a fluid, the atomizer disk comprising:

an upper cover layer including at least two inlet openings;

a lower base layer including at least one outlet opening;

a middle swirl generation layer including a swirl chamber; and at least two swirl channels extending to the swirl chamber, only one of the inlet openings terminating into a respective one channel of the swirl channels, wherein each of the inlet openings has a respective horizontal inflow cross section which is smaller than a smallest vertical swirl channel cross section of each of the swirl channels, and wherein the lower base layer, the middle swirl generation layer and the upper cover layer are built up on one another in a directly adhering manner using an electroplating metal deposition procedure.

16. The atomizer disk according to claim 15, wherein the swirl channels include ends which face away from the swirl chamber, the ends including inlet regions which are spaced apart from an outer circumference of the atomizer disk by a circumferential rim region composed of the at least one metallic material.

17. The atomizer disk according to claim 15, wherein the at least one outlet opening has one of a circular shape, an elliptical shape, a polygonal shape and a combination of the circular, elliptical and polygonal shapes.

18. The atomizer disk according to claim 15, wherein the at least one outlet opening is arranged in the lower base layer substantially in one of a centroid manner and an eccentric manner with respect to an axis of symmetry of the atomizer disk.

19. The atomizer disk according to claim 15, wherein the atomizer disk is provided for an injection valve.

20. The atomizer disk according to claim 15, wherein the electroplating metal deposition procedure includes a multilayer electroplating procedure.

21. A fuel injection valve for a fuel injection system of an internal combustion engine and having a longitudinal valve axis, the fuel injection valve comprising:

a valve seat element;

a fixed valve seat situated on the valve seat element;

an actuator including a movable valve part coacting with the fixed valve seat for opening and closing the fuel injection valve; and a multilayer atomizer disk situated downstream from the fixed valve seat and being composed of at least one metallic material, the multilayer atomizer disk including:

a lower base layer including at least one outlet opening, a middle swirl generation layer including a swirl chamber, at least two swirl channels extending to the swirl chamber, an upper cover layer including at least one inlet opening situated only above the swirl chamber, and inlet regions situated externally from the upper cover layer for supplying a fluid to the swirl channels, wherein the lower base layer, the middle swirl generation layer and the upper cover layer are built up on one another in a directly adhering manner using an electroplating metal deposition procedure.

22. The fuel injection valve according to claim 21, wherein the middle swirl generation layer is composed of a plurality of material regions which are spaced apart from one another in a circumferential direction, the material regions defining the contours of the swirl chamber and the swirl channels using respective geometrical positions of the material regions with respect to one another.

23. The fuel injection valve according to claim 22, wherein the material regions include four material regions, and wherein the swirl chamber and four channels of the swirl channels are arranged between the four material regions.

24. The fuel injection valve according to claim 22, wherein the material regions extend at a predetermined distance from an outer circumference of the lower base layer, the lower base layer defining an outside diameter of the atomizer disk.

25. The fuel injection valve according to claim 24, wherein the material regions extend in a strut-like manner.

26. The fuel injection valve according to claim 24, wherein the material regions have ends which face toward the swirl chamber, the ends being rounded off in a blade shape.

27. The fuel injection valve according to claim 22, wherein the material regions delimit the swirl chamber which has one of a circular shape, an elliptical shape, a polygonal shape and a combination of the circular, elliptical and polygonal shapes.

28. The fuel injection valve according to claim 21, wherein the at least one inlet opening exhibits one of a partial offset and a complete offset with respect to the at least one outlet opening.

29. The fuel injection valve according to claim 21, wherein the at least one inlet opening is provided concentrically with the at least one outlet opening.

30. The fuel injection valve according to claim 21, wherein the at least one outlet opening has a circular shape, an elliptical shape, a polygonal shape and a combination of the circular, elliptical and polygonal shapes.

31. The fuel injection valve according to claim 21, wherein the at least one outlet opening is arranged in the lower base layer substantially in one of a centroid manner and an eccentric manner with respect to an axis of symmetry of the multilayer atomizer disk.

32. The fuel injection valve according to claim 21, wherein the upper cover layer has an outside diameter which is smaller than an outside diameter of the lower base layer.

33. The fuel injection valve according to claim 21, wherein the multilayer atomizer disk is provided for an injection valve.

34. The fuel injection valve according to claim 21, wherein the electroplating metal deposition procedure includes a multilayer electroplating procedure.

35. The fuel injection valve according to claim 21, wherein the fuel injection valve is provided for a direct injection of a fuel into a combustion chamber of the internal combustion engine.

36. The fuel injection valve according to claim 21, wherein the multilayer atomizer disk is mounted in one of a retaining element and in a valve seat support by one of a welding procedure, an adhesive bonding procedure and a clamping procedure.

37. A fuel injection valve for a fuel injection system of an internal combustion engine and having a longitudinal valve axis, the fuel injection valve comprising:

a valve seat element;

a fixed valve seat situated on the valve seat element;

an actuator including a movable valve part coacting with the fixed valve seat for opening and closing the fuel injection valve; and a multilayer atomizer disk situated downstream from the fixed valve seat and composed of at least one metallic material, the multilayer atomizer disk including:

an upper cover layer including at least two inlet openings;

a lower base layer including at least one outlet opening;

a middle swirl generation layer including a swirl chamber; and at least two swirl channels extending to the swirl chamber, only one of the inlet openings terminating into a respective one channel of the swirl channels, wherein each of the inlet openings has a respective horizontal inflow cross section which is smaller than a smallest vertical swirl channel cross section of each of the swirl channels, and wherein the lower base layer, the middle swirl generation layer and the upper cover layer are built up on one another in a directly adhering manner using an electroplating metal deposition procedure.

38. The fuel injection valve according to claim 37, wherein the swirl channels include ends which face away from the swirl chamber, the ends including inlet regions which are spaced apart from an outer circumference of the multilayer atomizer disk by a circumferential rim region composed of the at least one metallic material.

39. The fuel injection valve according to claim 37, wherein the at least one outlet opening has one of a circular shape, an elliptical shape, a polygonal shape and a combination of the circular, elliptical and polygonal shapes.

40. The fuel injection valve according to claim 37, wherein the at least one outlet opening is arranged in the lower base layer substantially in one of a centroid manner and an eccentric manner with respect to an axis of symmetry of the multilayer atomizer disk.

41. The fuel injection valve according to claim 37, wherein the multilayer atomizer disk is mounted in one of a retaining element and in a valve seat support by one of a welding procedure, an adhesive bonding procedure and a clamping procedure.

42. The fuel injection valve according to claim 37, wherein the multilayer atomizer disk is provided for an injection valve.

43. The fuel injection valve according to claim 37, wherein the electroplating metal deposition procedure includes a multilayer electroplating procedure.

44. The fuel injection valve according to claim 37, wherein the fuel injection valve is provided for a direct injection of a fuel into a combustion chamber of the internal combustion engine.

* * * * *

UNITED STATES PATENT AND TRADEMARK OFFICE

CERTIFICATE OF CORRECTION

PATENT NO. : 6,161,782
DATED : December 19, 2000
INVENTOR(S) : Heinbuch et al.

It is certified that error appears in the above-identified patent and that said Letters Patent is hereby corrected as shown below:

Column 1,
Line 6, after “actuatable” and before “region”, insert -- fuel injection valve in which several disk-shaped elements are arranged in the seat --.

Column 9,
Line 27, change “described, above it” to -- described above, it --.

Signed and Sealed this

Twenty-seventh Day of August, 2002

*Attest:*

*Attesting Officer*

JAMES E. ROGAN
*Director of the United States Patent and Trademark Office*